United States Patent [19]

Smith

[11] Patent Number: 4,570,448

[45] Date of Patent: Feb. 18, 1986

[54] ECONOMIZER CONTROL APPARATUS

[75] Inventor: Gary A. Smith, Plymouth, Minn.

[73] Assignee: Honeywell Inc., Minneapolis, Minn.

[21] Appl. No.: 531,988

[22] Filed: Sep. 12, 1983

[51] Int. Cl.[4] ..... F25B 29/00

[52] U.S. Cl. ..... 62/89; 62/180; 165/16

[58] Field of Search ..... 236/49; 165/16; 62/180, 62/332

[56] References Cited

U.S. PATENT DOCUMENTS 2,309,411 1/1943 Miller et al. ..... 165/16

4,147,038 4/1979 Hoebing et al. ..... 62/180

4,347,712 9/1982 Benton et al. ..... 236/49 X 4,379,484 4/1983 Lom et al. ..... 236/49 X

*Primary Examiner*—William E. Wayner

*Attorney, Agent, or Firm*—Charles L. Rubow

[57] ABSTRACT

A control system and method for space temperature regulating equipment are disclosed in which mechanical cooling equipment is controlled as a function of sensed space temperature and a first temperature set point; and an economizer for admitting low enthalpy outside air is controlled as a function of sensed space temperature and a second temperature set point independent of the first temperature set point.

7 Claims, 5 Drawing Figures

ECONOMIZER CONTROL APPARATUS

BACKGROUND OF THE INVENTION

The invention disclosed herein relates generally to systems for controlling the operation of equipment which regulates temperature in an air conditioned space, and more particularly to a control system for temperature regulating equipment including mechanical cooling equipment and an economizer for admitting outside air under suitable conditions.

It is well known in systems for regulating the temperature in an air conditioned space to use outside air to assist in maintaining the desired space air temperature when the outdoor air conditions are suitable for that purpose. Suitability of the outside air depends on its enthalpy which is a function of both its temperature and humidity. Outside air is typically brought into the air conditioned space through economizer equipment.

In general, a conventional economizer is set to operate at a control point temperature which has a predetermined relationship with the set point temperature of associated mechanical cooling equipment. Accordingly, the economizer control point may be a fixed number of degrees below the mechanical cooling set point, or it may be determined in accordance with a particular relationship with the mechanical cooling set point.

Conventional economizer equipment provides significant economic benefits in many space cooling applications. However, it lacks flexibility in some situations. For example, it may be desired to maximize economy of operation by operating mechanical cooling equipment only when a relatively high space temperature is reached. At the same time, it may be desired to have the comfort benefits of suitable outside air at the lowest temperature any benefit can be realized therefrom, even though there may be a variable range of temperatures below the mechanical cooling set point in which the economizer is not capable of maintaining a control point temperature.

The applicant has devised a control system and operating method for a temperature regulating system including mechanical cooling equipment and an economizer which offers substantial flexibility in the operation. Among other things, the applicant's system and method permits control of an economizer substantially independently of control of associated mechanical cooling equipment.

SUMMARY OF THE INVENTION

The control system of the present invention basically comprises a space temperature sensor, means for entering first and second temperature set points, and controller means for controlling operation of mechanical temperature changing equipment as a function of the space temperature and the first temperature set point and controlling operation of an economizer as a function of the space temperature and the second temperature set point.

The system may also include a sensor for sensing enthalpy of the outside air and means for preventing the admission of outside air when its enthalpy is higher than a predetermined value. The system may further include a sensor for sensing the temperature of air discharged into the air conditioned space and means for controlling operation of the economizer as a function of discharge air temperature.

The method of the applicant's invention comprises sensing a temperature in the air conditioned space, establishing first and second set points, and controlling mechanical temperature changing equipment as a function of the space temperature and the first temperature set point and controlling an economizer as a function of the space temperature and the second temperature set point.

DESCRIPTION OF THE PREFERRED EMBODIMENT

Figure 1:
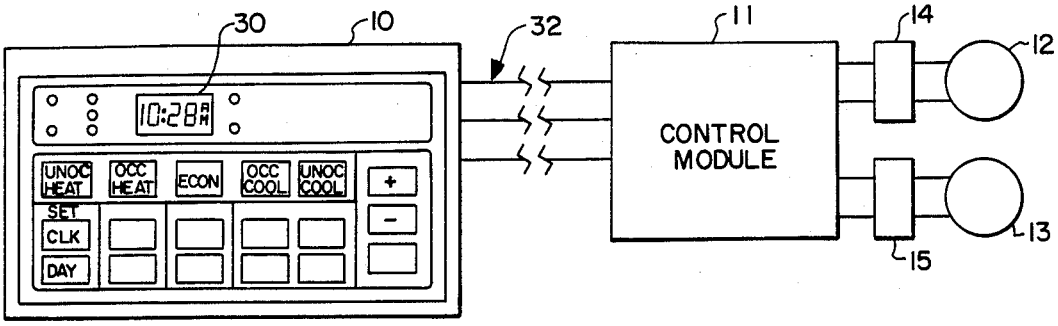
FIG. 1 illustrates, in block diagram form, space temperature control apparatus in accordance with the applicant's invention, including a control panel for establishing temperature set points and other control variables.

The apparatus shown in FIG. 1 includes a thermostat module 10 intended for location in an air conditioned space and a remotely located control module 11 which is capable of providing control signals to a variety of temperature changing equipment. Reference numeral 12 identifies a motor for driving a compressor in mechanical cooling equipment. Reference numeral 13 identifies a motor for positioning a damper in an economizer for admitting outside air to be mixed with air within the air conditioned space and associated air conditioning equipment. Each of motors 12 and 13 may be connected to control module 11 through an interface device, such as 14 and 15 respectively, which, among other things, may perform certain supervisory functions required for optimum operation of the particular mechanical cooling and economizer equipment being controlled.

Figure 2:
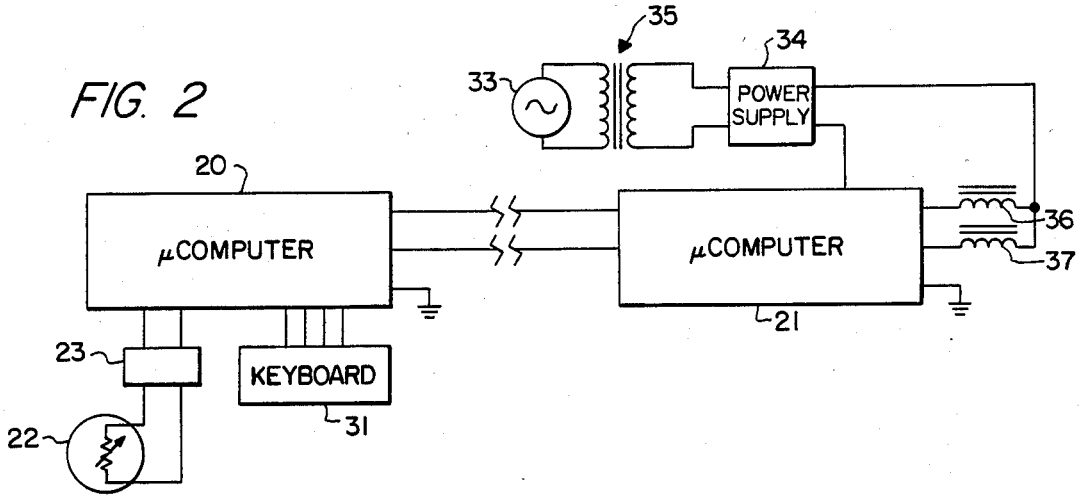
FIG. 2 generally illustrates the interconnection of microcomputers and certain input, sensing and output interfaces used in the apparatus of FIG. 1.

Thermostat module 10 and control module 11 each includes a programmed microcomputer identified by reference numerals 20 and 21 respectively in FIG. 2. For purposes of the present description, the principal functions of microcomputer 20 are to keep the time of day, store periodically updated sensed space temperature, provide for entry of temperature set points, provide for entry of control period start times, store set points and control period start times, and communicate with microcomputer 21.

Space temperature is sensed by a temperature sensing device 22 connected to microcomputer 20 through an interface device 23. Temperature sensing device 22 is preferrably located in thermostat module 10.

As shown in FIG. 1, thermostat module 10 includes a multiple digit, multiple function display 30 for normally displaying either time of day or sensed temperature, depending on which is selected, and temporarily displaying control period start times and temperature set points. Time and temperature set points are entered by means of a keyboard generally identified by reference numeral 31. Keyboard 31 includes a plurality of labeled set/recall keys, a "+" key and a "−" key.

Microcomputer 20 is programmed to provide for time and temperature set point entries, which are made by depressing an appropriate set/recall key followed by depressing the + or − key to increment or decrement a value which appears on display 30. Upon release of the + or − key, the value on the display is immediately entered into a working register in microcomputer 20. Depression of any other set/recall or display key results in transfer of the value stored in the working register into an appropriate main register in microcomputer 20. If no other set/recall or display key is depressed within a two minute timeout period, the value in the working register is automatically transferred to the appropriate main register at the end of the period.

Thermostat module 10 is connected to control module 11 through a plurality of conductors 32 which provide for transmission of communications from microcomputer 20 to microcomputer 21, as well as supplying electrical power to thermostat module 10. The principal functions of microcomputer 21 are to communicate with microcomputer 20, and to generate control signals for heating, economizer and cooling equipment in accordance with a control algorithm which, among other inputs, uses sensed space temperature, temperature set points and operational mode information received from microcomputer 20.

Primary electrical power for the system is supplied from a source of alternating current electrical power 33 such as a public utility. The source frequency is typically closely regulated at 50 or 60 cycles per second, which characteristic is used by microcomputer 20 to keep the time of day and provide control period start times. The voltage from source 33 is provided to a power supply 34 through a voltage reducing transformer 35. Power supply 34 furnishes power of the required characteristics to microcomputers 20 and 21, as well as relays 36 and 37 which control cooling equipment.

Figure 5:
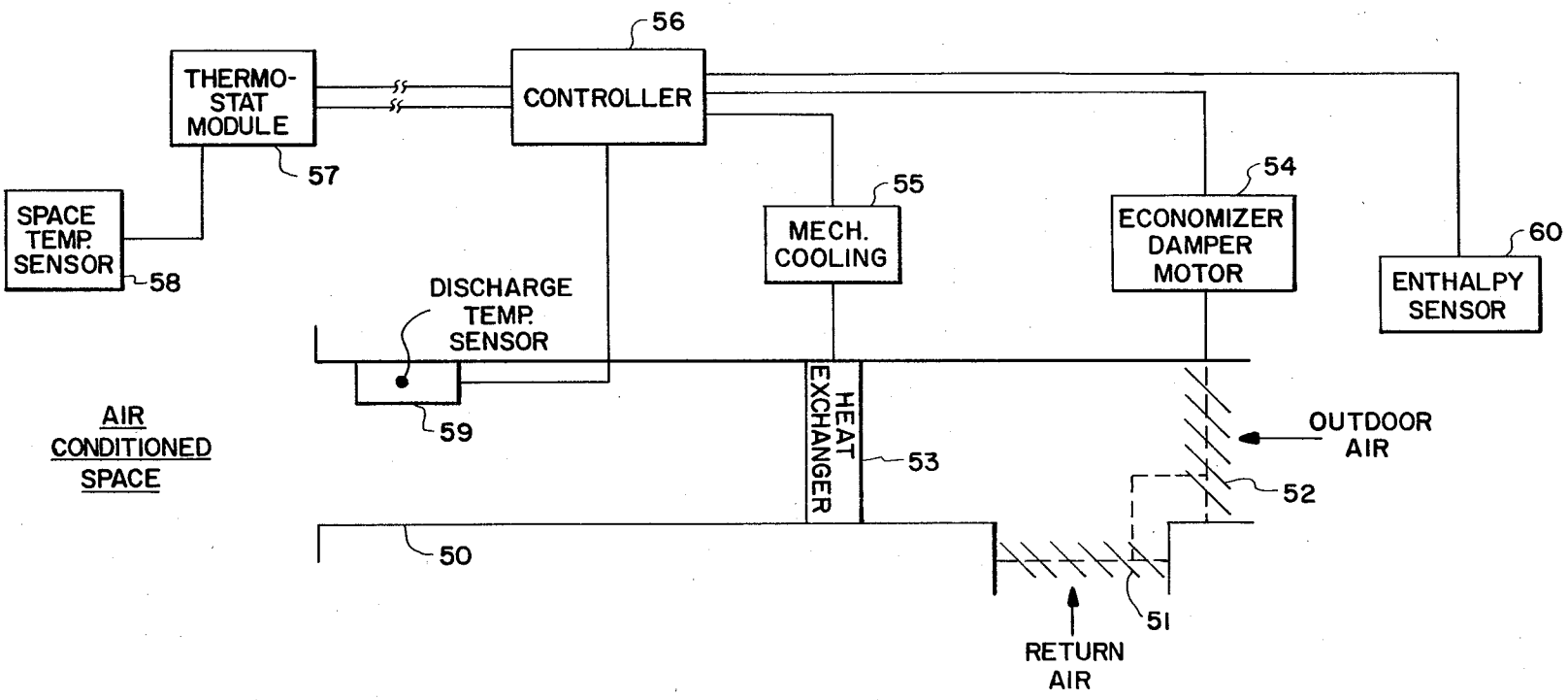
FIG. 5 is a block diagram of a conditioned air delivery system including the apparatus of FIGS. 1 and 2.

FIG. 5 illustrates a complete system, including the above-described economizer control apparatus, for delivering conditioned air to an air conditioned space. Reference numeral 50 identifies a duct for delivering air to the space. The delivered air comprises a combination of return air from the space drawn through a return air damper 51 and outdoor air drawn through an outdoor damper 52. The combined return and outdoor air is drawn through a heat exchanger 53 in duct 50. Dampers 51 and 52 are mechanically coupled and positioned by an economizer damper motor 54. Heat exchanger 53 is supplied with a suitably cooled fluid from mechanical cooling equipment 55, such as an air conditioner compressor.

Damper motor 54 and mechanical cooling equipment 55 are controlled by a controller 56 corresonding to control module 11 in FIG. 1 which receives input signals indicative of space temperature and system setpoints from a thermostat module 57 corresponding to module 10. Thermostat module 57 includes a space temperature sensor 58 corresponding to sensor 22 in FIG. 2.

Controller 56 also receives input signals from a discharge temperature sensor 59 located in duct 50 downstream from heat exchanger 53 and an enthalpy sensor 60 located to sense the enthalpy of the outdoor air.

Figure 3:
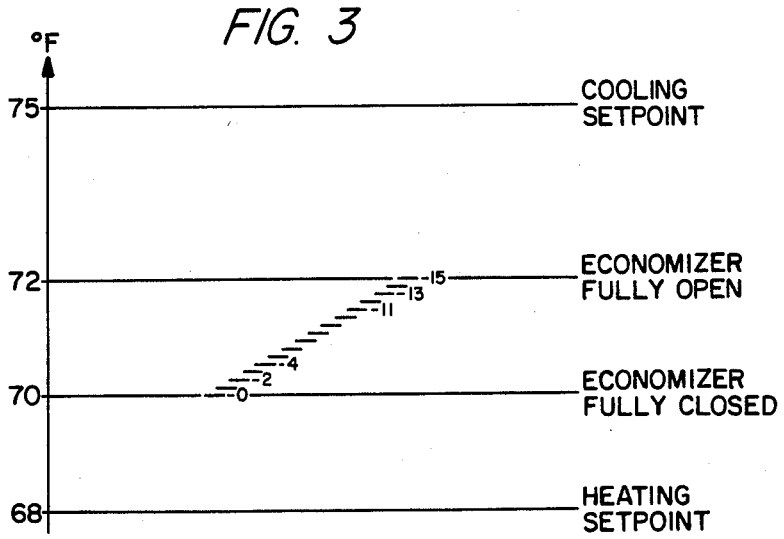
FIG. 3 is a graphical representation of a schedule illustrating operating ranges of mechanical heating and cooling equipment and an economizer in accordance with the applicant's invention.

FIG. 3 illustrates control set points for a temperature control system in which the economizer set point is set at 70° F. The economizer to which the diagram relates is one in which the motor is capable of positioning a damper at any of 16 discrete positions labeled 0–15. At a space temperature of 70° and below the economizer damper is fully closed. At a space temperature of 72 and above the economizer damper is fully opened.

The economizer set point is substantially independent of the temperature set points for mechanical heating and cooling equipment. However, in order to provide efficient system operation, the economizer set point is required to be a minimum of 2° above the heating set point and the cooling set point is required to be a minimum of 3° above the economizer set point. Since the economizer set point is lower than the mechanical cooling set point, cooler space temperatures can be obtained when it is cool outside, and no mechanical cooling is necessary until higher space temperatures occur. Thus, when the economizer alone can cool the space to a temperature below the mechanical cooling set point, the mechanical cooling equipment is not unnecessarily cycled and the use of free cooling is maximized.

For the economizer whose operation is shown in FIG. 3, the desired position is computed based on space temperature deviation above the economizer set point. The difference between the computed desired position and the internally tracked commanded position determines the command given to the economizer. When the commanded position is too low, a command to increment the economizer is given. To prevent overshoot, excessive cycling and other undesirable consequences, the rate at which the position of the economizer damper is permitted to change is limited. In a specific embodiment, only one reposition increasing or decreasing the position of the damper per minute is permitted.

As an example of the foregoing, assume that the space temperature is 1 degree above the economizer set point. Also assume that the internal commanded position is zero. The desired position would be halfway open or position 7. When the temperature control procedures are executed, an open command would be relayed to the economizer and the commanded position would be incremented to position 1. The next pass through the temperature control algorithm, the same procedure would be executed and the commanded position would be incremented to position 2. Assuming that the temperature did not change, the algorithm would increment one position each minute and stop at commanded position 7 after seven minutes. Similarly, the economizer control program is designed so that, in the event the space temperature falls, the commanded position does not change until a ¼th degree drop occurs.

The economizer control program is also designed so that the economizer cannot be issued a command to open when the temperature of the air discharged into the space is between 50 degrees and 54 degrees. Below 50 degrees the economizer is commanded to close one position every two minutes until the discharge air temperature goes above 50 degrees. Closure of the economizer is prohibited in the event that any mechanical cooling has been on less than four minutes ago, or if mechanical cooling is on presently. In the event that mechanical cooling is on and the discharge temperature is below 50 degrees, the control commands a stage of mechanical cooling off. This maximizes the use of free cooling.

The economizer control system is also capable of providing control commands to an economizer of the type in which the damper is not capable of being positioned between fully opened and fully closed, but in which the damper is cycled between opened and closed, with the relative amounts of time in opened and closed positions being variable as a function of the space temperature and economizer set point. In such an application, the economizer control issues on and off commands using the economizer temperature set point in a cycler algorithm. The result of the logic plus cycler computation is used to issue on/off commands via relays to the economizer and mechanical cooling stages. In this application, the relay commands are passed through the economizer interface device where the state of outdoor enthalpy is used to determine if the economizer can be used or not. When enthalpy is low, the first stage of cooling will command the economizer to open or close. When enthalpy is high, the first stage of cooling is mechanical cooling. Thus, the sensed enthalpy is used to avoid fast cycling and incorrect cycler integral error. Otherwise, short or fast cycling could occur when enthalpy changes from high to low or low to high.

Figure 4:
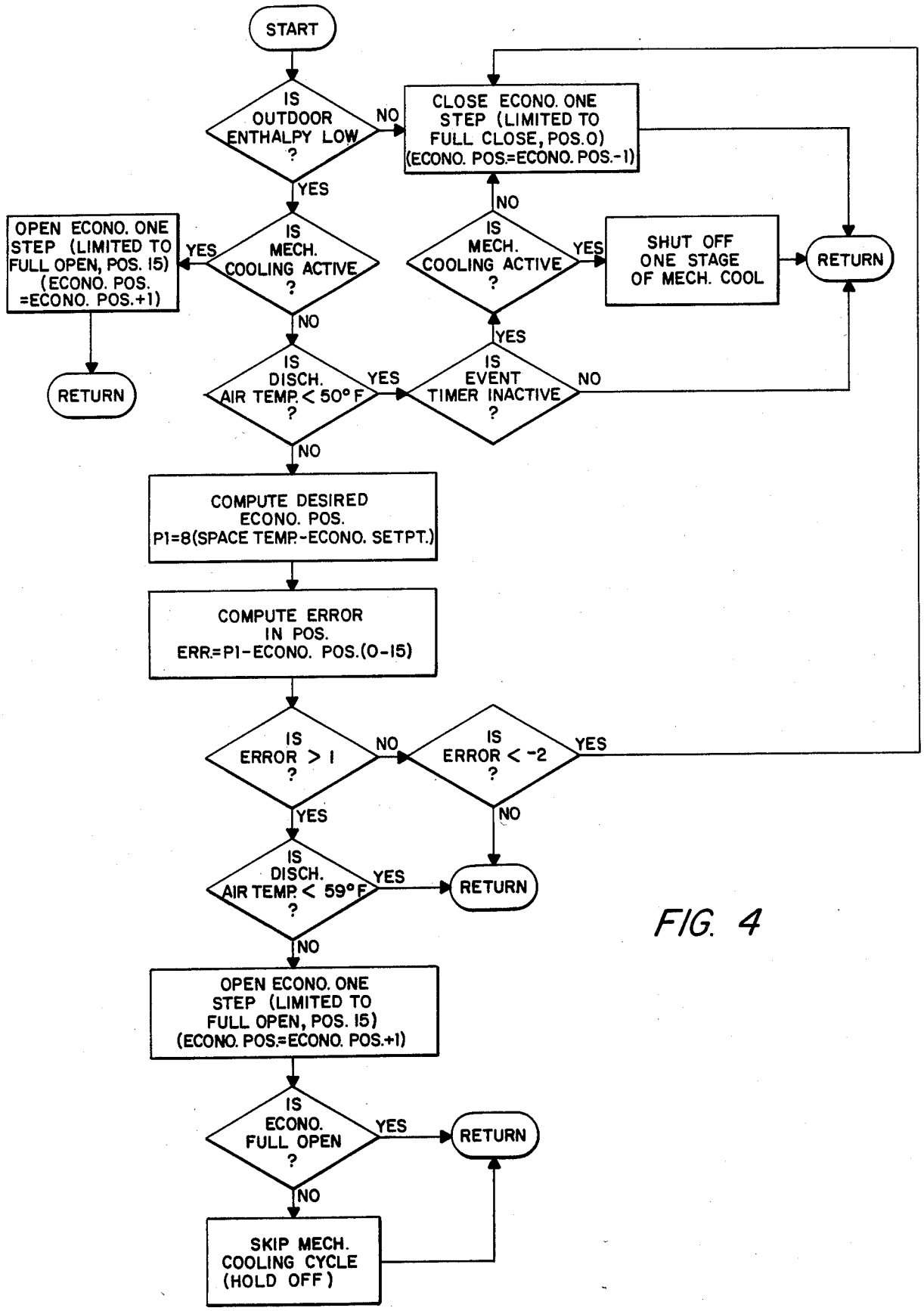
FIG. 4 is a flow diagram of the economizer control program for the apparatus of FIGS. 1 and 2.

The program used in the control module for accomplishing the preceding described operation with a sixteen position economizer is set forth in the flow diagram of FIG. 4. As apparent from the flow diagram, the first decision is whether or not a signal from an enthalpy sensor indicates that outdoor enthalpy is lower than a predetermined value, and thus useful for space cooling. If not, the economizer damper is closed.

In accordance with the foregoing discussion, the applicant has provided a unique economizer control system which offers maximum flexibility in air conditioning system control. In addition, the economizer control algorithm provides for optimum use of free cooling and maximizes efficiency of coordinated operation of the economizer and mechanical cooling equipment.

Although a specific example of the applicant's economizer control system has been shown and described for illustrative purposes, a number of variations and modifications within the applicant's contemplation and teaching will be apparent to those skilled in the relevant arts. It is not intended that coverage of the invention be limited to the embodiment disclosed, but only by the terms of the following claims.

The embodiments of the invention in which an exclusive property or right is claimed are defined as follows:

1. Thermostat apparatus for a system for controlling temperature in an air conditioned space by means of mechanical temperature changing equipment and an economizer for admitting outside air, said thermostat apparatus comprising:

a temperature sensor for sensing a temperature in the air conditioned space;

first set point means for establishing a first temperature set point;

an enthalpy sensor for sensing enthalpy of the outside air;

second set point means for establishing a second temperature set point substantially independent of the first temperature set point;

a discharge air temperature sensor for sensing the temperature of air discharged into the air conditioned space; and controller means for controlling operation of the mechanical temperature changing equipment as the function of the temperature in the air conditioned space and the first temperature set point, and controlling operation of the economizer as a function of the temperature in the air conditioned space, the air discharged into the air conditioned space and the second temperature set point when the enthalpy of the outside air is lower than a predetermined value, said controller means maintaining said economizer closed when the enthalpy of the outside air is higher than the predetermined value.

2. The thermostat apparatus of claim 1 wherein said controller means is operable to position an air flow control device in the economizer within a range of positions between fully opened and fully closed.

3. The thermostat apparatus of claim 2 wherein said controller means is operable to limit the change in position of the flow control device to not more than a predetermined difference in positions per a predetermined time interval.

4. The thermostatic apparatus of claim 3 wherein said means for controlling the position of the air flow control device as a function of discharge air temperature is operable ro prevent further opening of the air flow control device when the discharge air is at less than a first predetermined temperature.

5. The thermostatic apparatus of claim 4 wherein said means for controlling the position of the air flow control device as a function of discharge air temperature is operable to close the air flow control device when the discharge air is at less than a second predetermined temperature lower than the first predetermined temperature.

6. A method of controlling temperature in an air conditioned space by means of mechanical temperature changing equipment and an economizer for admitting outside air, said method comprising the steps of:

sensing a temperature in the air conditioned space;

establishing a first temperature set point;

controlling operation of the mechanical temperature changing equipment as the function of the temperature in the air conditioned space and the first temperature set point;

sensing the enthalpy of the outside air;

establishing a second temperature set point substantially independent of the first temperature set point;

sensing the temperature of air discharged into the air conditioned space;

controlling operation of the economizer as a function of the temperature in the air conditioned space and the second temperature set point; and permitting admission of outside air into the air conditioned space only if the enthalpy of the outside air is less than a predetermined value and preventing any increase in the admission of outside air if the discharged air is at less than a predetermined temperature.

7. The method of claim 6 wherein the step of controlling operation of the economizer comprises positioning an air flow control device in the economizer within a range of positions between fully opened and fully closed as a function of the difference between the temperature in the air conditioned space and the second temperature set point.

* * * * *